US005896016A

United States Patent [19]

Bayer

[11] Patent Number: 5,896,016

[45] Date of Patent: Apr. 20, 1999

[54] PROCESS FOR OPTIMIZING EFFICIENCY IN SHIPS WITH BOW AND STERN SCREWS AND ARRANGEMENT FOR ADJUSTING THE ROTATION SPEED OF THE BOW SCREW

[75] Inventor: Karl-Heinz Bayer, Kleinsendelbach, Germany

[73] Assignee: Siemens AG, Munich, Germany

[21] Appl. No.: 08/793,635

[22] PCT Filed: Aug. 23, 1995

[86] PCT No.: PCT/DE95/01116

§ 371 Date: Jun. 27, 1997

§ 102(e) Date: Jun. 27, 1997

[87] PCT Pub. No.: WO96/06774

PCT Pub. Date: Mar. 7, 1996

[30] Foreign Application Priority Data

Aug. 26, 1994 [DE] Germany ..... 44 30 409

[51] Int. Cl.[6] ..... B63H 21/17; B63H 21/22

[52] U.S. Cl. ..... 318/68; 318/53; 440/6; 440/79

[58] Field of Search ..... 318/53, 54, 55, 318/59, 65, 66, 67, 68, 99; 440/6, 49, 79, 80

[56] References Cited

U.S. PATENT DOCUMENTS

| | | | |
|---|---|---|---|
| 4,836,809 | 6/1989 | Pelligrino . | |
| 5,009,621 | 4/1991 | Bankstahl et al. | 440/75 |
| 5,441,388 | 8/1995 | Berger | 416/125 |

FOREIGN PATENT DOCUMENTS

| | | |
|---|---|---|
| 32 22 054 | 12/1983 | Germany . |
| 32 48 958 | 6/1987 | Germany . |
| 42 17 138 | 4/1994 | Germany . |

OTHER PUBLICATIONS

Ship & Boat International, May 1983, p. 11, "Rudder Propellers For Road Ferry Propulsion".

Reinhold Knecht, "Die Schottel–Masterpilot–Steuerung", HANSA–Schiffahrt–Schiffbau–Hafen, 1986, No. 22/23, pp. 1819–1822.

Marine Propulsion, May/Jun. 1988, p. 35, "A.c. Thruster Drives For Pipelayer".

Schiff & Hafen/Seewirtschaft, Jul. 1990, p. 84, "ETA–Pilot Now Marked By SSPA".

Van Obering H. Heuser, "Linienentwurf und Modelluntersuchung von Groben, Schnellen Binnenfrachtschiffen Geringer Volligkeit", Schiff & Hafen, Jan. 1965, No. 17, pp. 10–13.

Schiff & Hafen, Jun. 1974, No. 6, p. 570, "Grobauftrag fur MaK Maschinenbau".

*Primary Examiner*—Bentsu Ro

*Attorney, Agent, or Firm*—Kenyon & Kenyon

[57] ABSTRACT

Ferries in particular may have identical drives at the bow and stern in order to avoid turning the ship when the direction of travel changes. Normally, when travelling, the rotation speed of the front screw is selected to be lower than the rotation speed of the rear screw. According to the invention, minimum-value regulation of the sum of the recorded real power levels of both drive systems is used for efficiency optimization. In the case of the associated arrangement, a regulator (10) is provided, with the real power levels of both drives as input variables, that rotation speed of the bow screw at which the sum of the real power levels is a minumum being determined in the regulator (10).

9 Claims, 1 Drawing Sheet

PROCESS FOR OPTIMIZING EFFICIENCY IN SHIPS WITH BOW AND STERN SCREWS AND ARRANGEMENT FOR ADJUSTING THE ROTATION SPEED OF THE BOW SCREW

REFERENCE TO RELATED APPLICATIONS

This application is a National Stage of International Application, PCT/DE95/01116 under 35 USC §371, filed Aug. 23, 1995.

BACKGROUND OF THE INVENTION

The invention relates to a method for optimizing the efficiency of bow and stern screws in ships—particularly ferries—where the rotational speed of the front screw (i.e. bow screw) is in each case less than the rotational speed of the rear screw (i.e. stern screw). In addition, the invention also relates to the associated arrangement for adjusting the rotation speed of the bow screw in those ships having a symmetrical screw arrangement and respectively associated separate drives.

Modern ferries may have a bow screw and a stern screw, which are each driven by separate drives. Such an arrangement avoids having to turn the ship in order to reverse its direction of motion. Such ships with a symmetrical screw arrangement are normally operated with a symmetrical screw arrangement in accordance with an empirically derived characteristic. In particular, this means that the front screw is driven at a rotational speed which is about 10% lower than the rotational speed of the rear screw, depending on the direction of travel, in order as far as possible to avoid in particular any braking effect from the front screw, which cannot be used for thrust.

As is known, the braking effect increases the power consumption of the entire vessel system. A multiplicity of factors which cannot be measured, but which nevertheless influence the optimum rotation speed of the front screw, cannot be taken into account where one merely relies upon previous empirical solutions. Hence, the known procedure remains unsatisfactory in many respects. The efficiency of the entire drive system is, under some circumstances, poor, since changing flow conditions, wave motion and similar external factors are not detected exactly.

SUMMARY OF THE INVENTION

An object of the invention is to provide an improved method and apparatus for the adjustment of the rotational speed of the bow screw to a value which leads to a more favorable overall level of drive power consumption at any ship speed and for any other influencing factors.

The object is achieved via a method in which the minimum-value regulation of the sum of the recorded real power levels of both drive systems is carried out for efficiency optimization. The associated arrangement for adjusting the rotational speed of the bow screw is characterized by a regulator using the real power levels of both drives as input variables, that rotational speed of the bow screw at which the sum of the real power levels is a minimum being determined in the regulator.

This method can be used to supplement initial control using empirical values, and provide a correction to these values. Optimization can also take place even during the running-up process of the stern screw. In the so-called split mode, that is to say when moving slowly in a harbor basin or the like, the helmsman is nevertheless given complete freedom to use both drives independently.

It is advantageous in the case of the invention that it is no longer absolutely essential to determine and implement empirical characteristics in advance, and that movement nevertheless takes place with a minimized total power. Since the drive power levels in ferries are normally in the MW range, a not inconsiderable energy saving may be expected overall.

BRIEF DESCRIPTION OF THE DRAWINGS

For a more complete understanding of this inventory reference should now be made to the embodiment illustrated in the FIGURE, which shows a schematic block diagram of a system providing such minimum-value regulation in ferries.

DETAILED DESCRIPTION

Figure 1:
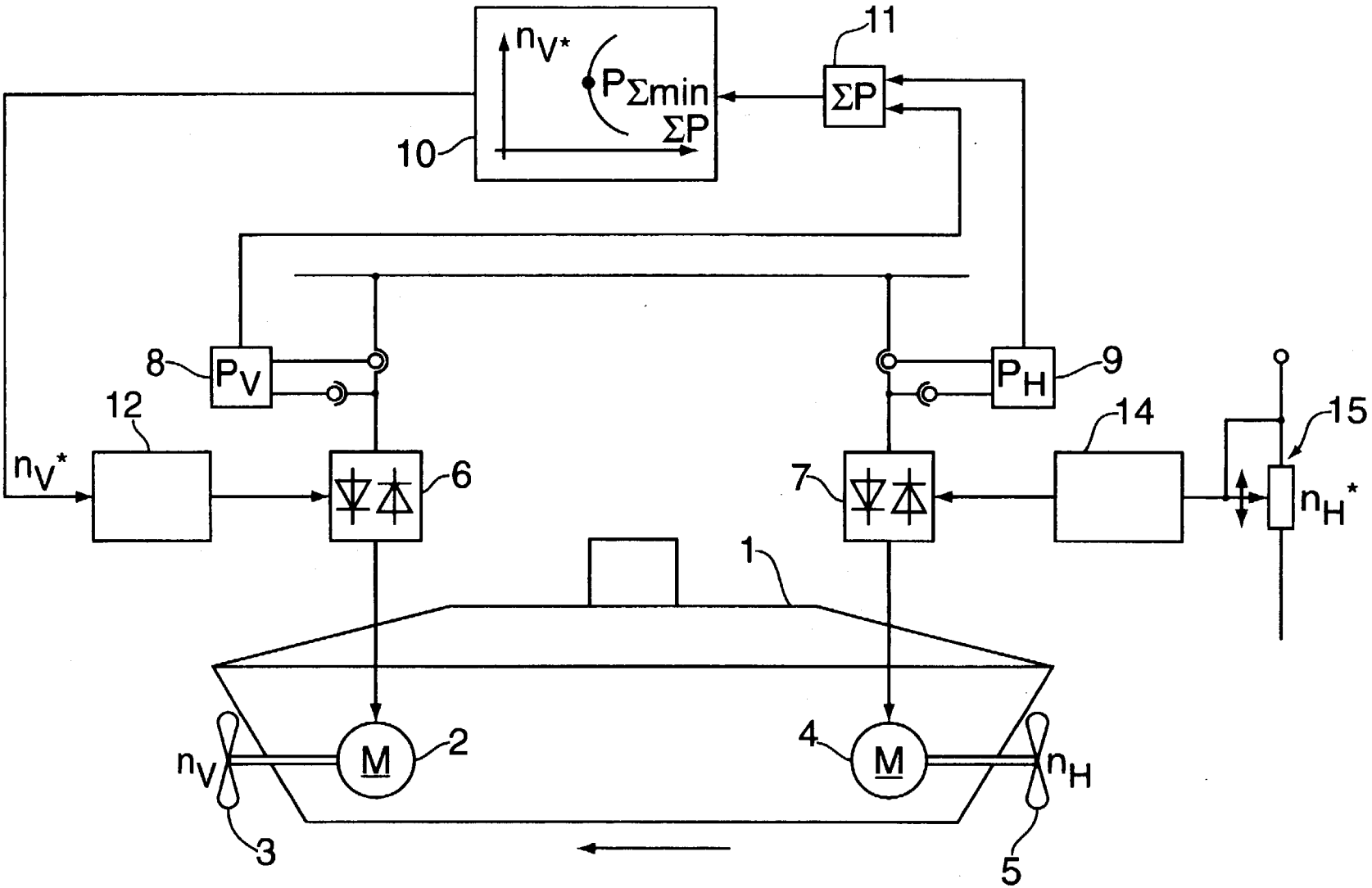

In the FIGURE, 1 indicates a ferry which has a complete drive system both at the bow and at the stern, which drive systems are of identical construction. In consequence, while traveling, such ships are able to reverse the direction of travel without any turning maneuver. In detail, the figure shows a first engine 2, with the associated screw 3, and a second engine 4 with the associated screw 5. Both engines 2 and 4 are driven via suitable power control elements 6 and 7, which are connected to the ship power supply.

The power levels respectively consumed by the individual engines 2 and 4 can be detected via transducers 8 and 9. The measured values are supplied to a regulator 10 and are processed there. A summation element 11 is expediently connected upstream of the regulator 10, so that the sum of the two power levels is actually input as the input variable.

The two engines 2 and 4, respectively, are each assigned a unit 12 and 14, respectively, for rotation speed regulation. In the present case, the unit 14 is coupled to an engine telegraph 15, so that a suitable rotation speed can be set for the purpose of controlling the speed of the ship.

The regulator 10 operates as a minimum-value regulator. Specifically, this means that, when a specific stern screw rotation speed is preset and a bow screw rotation speed is set which is firstly in accordance to the state of art lower by about 10%, the respectively consumed power levels are detected by the transducers 8 and 9 and are supplied via the summation element 11 to the regulator 10. The regulator 10 adjusts the rotation speed of the front screw drive until the sum value of the recorded real power levels of both drive systems is brought to a minimum for the given application.

In a practical implementation, the minimum-value regulator 10 is designed as a digital regulator. It can thus carry out an additional function as well as the normal drive regulation functions and does not require any additional system variables as regulation actual values for this purpose. When the direction of travel changes, the rotation speed nominal value control of both drive systems can be changed directly, electronically.

The power to be used for the entire system can thus be reduced in a comparatively simple manner by the described regulation concept. Efficiency optimization is thus achieved.

In practice, it may be expedient to start from the known empirical initial control and to use the described minimum-value regulation in particular for correction of the existing characteristics of that initial empirical control. The described efficiency optimization may be carried out even during the process of accelerating the ship. Full ship maneuverability is provided independently of this in the so-called split mode, that is to say when moving slowly in a harbor basin or the like. Both screw engines can thus be operated independently of one another, in any desired direction, in this case without the described minimum-value regulation.

What is claimed is:

1. A method for optimizing the efficiency with which using bow and stern screws are utilized in ships having screws of these types, where the rotational speed of the bow screw is less than the rotational speed of the stern screw, comprising the steps of:

measuring the power level provided to the stern screw;

measuring the power level provided to the bow screw;

summing these power levels to obtain an aggregate power level; and minimizing the aggregate power so that the minimum amount of power is used for a given ship maneuver.

2. A method as claimed in claim 1, wherein when the bow and stern screws begin to rotate, they are initially controlled on the basis of empirical values which are then corrected so as to minimize the aggregate power that must be delivered to the screws.

3. The method as claimed in claim 2, wherein the level of power required is optimized during the running-up process.

4. The method as claimed in claim 1, wherein the level of power required is optimized during the running-up process.

5. An apparatus for adjusting the rotational speed of the bow screw in ships having a symmetrical screw arrangement, comprising:

a first screw having a first screw drive;

a second screw having a second screw drive;

means for determining the real power being fed to each of the two screws;

a regulator that, taking the sum of the real power levels being fed to the two screws as inputs, minimizes the power required by the screws to effect a given maneuver.

6. An apparatus as set forth in claim 5, wherein the regulator is a digital regulator.

7. An apparatus as set forth in claim 5, further comprising a summation element that provides the sum of the actual power levels in both drives as an input to the regulator.

8. An apparatus as set forth in claim 7, further comprising transducers to detect the actual power level of the first and second screw drives.

9. An apparatus as set forth in claim 5, further comprising means for changing the rotational speed of both drives when the direction of travel changes.

* * * * *